US005253600A

United States Patent [19]

Sugahara

[11] Patent Number: 5,253,600

[45] Date of Patent: Oct. 19, 1993

[54] VARIABLE NEEDLE TRAVELLING ARC IN A SCOOP-STITCH SEWING MACHINE

[75] Inventor: Masato Sugahara, Tokyo, Japan

[73] Assignee: Sugahara Machine Kabushiki Kaisha, Tokyo, Japan

[21] Appl. No.: 958,300

[22] Filed: Oct. 8, 1992

[30] Foreign Application Priority Data

May 22, 1992 [JP] Japan ..... 4-155779

[51] Int. Cl.[5] ..... D05B 1/24

[52] U.S. Cl. ..... 112/267.1; 112/35; 112/177; 112/222

[58] Field of Search ..... 112/35, 37, 2, 176, 112/179, 201, 220, 221, 262.1, 284, 177, 267.1, 412, 80.4, 222

[56] References Cited

U.S. PATENT DOCUMENTS 2,920,590 1/1960 Dunn ..... 112/176
3,338,196 8/1967 Roth ..... 112/176
3,341,873 9/1967 Miller ..... 112/35 X
3,347,190 10/1967 Roth ..... 112/176
3,734,039 5/1973 Krasnitz ..... 112/176
4,712,495 12/1987 Jagielski ..... 112/176
5,095,833 3/1992 Darrieux ..... 112/262.1 X

FOREIGN PATENT DOCUMENTS 2736780 11/1978 Fed. Rep. of Germany ..... 112/176
3-275096 12/1991 Japan ..... 112/176

*Primary Examiner*—Clifford D. Crowder
*Assistant Examiner*—Ismael Izaguirre
*Attorney, Agent, or Firm*—Juettner Pyle & Lloyd

[57] ABSTRACT

A method for scoop stitching includes the steps of changing the angle of attack of a curved needle before and after penetration of the needle into a fabric. The needle moves along an arc around an axis. The axis is reduced prior to needle penetration and is increased after penetration to assure good penetration depth in thick fabrics.

4 Claims, 8 Drawing Sheets

VARIABLE NEEDLE TRAVELLING ARC IN A SCOOP-STITCH SEWING MACHINE

BACKGROUND OF THE INVENTION

This invention relates to a needle motion mechanism in scoop-stitch machines which permits full penetration of a needle into cloth even in the shoulder part with thick pads so that a beautiful seam may be obtained in method of hemming on the sleeve lining in the shoulder part of a coat.

In the prior art of hemming on the sleeve lining in the shoulder part of a coat such as a business suit, thick pads in the shoulder part have made it difficult to fully push up the shoulder part from the opening of the needle plate.

Thus, in methods of hemming on the sleeve lining in the shoulder part of a coat, hand sewing has conventionally been employed. Alternatively, sewing from inside the cloth has been employed using sewing machines specially for stitching bulky materials, or conveniently, scoop-stitch sewing machines have been used first for scoop-stitching from inside and then after the lining is turned over. However, these widely used methods of machine sewing do not provide complete hemming on, for example, the sleeve lining in the shoulder part of a coat. Furthermore, the above procedures require much time and labor, reducing operational efficiency to a great degree.

In a scoop-stitch sewing machine, a curved needle is supported on the end of a pivoting arm, and the needle is swung in a fixed arc into engagement with fabric which is pushed up between spaced needle plates. The present invention relates to improvements in scoop-stitch sewing to assure good penetration of the needle into thick fabrics.

SUMMARY OF THE INVENTION

In view of the above facts, the present invention has been made, and it is an object of this invention to provide a needle motion mechanism in scoop-stitch sewing machines which permits full penetration of a needle even into thick fabrics fast and simply, performing efficient cloth sewing operation on fabrics that are of heavy weight.

According to the present invention, when a needle point approaches the fabric to be sewn, a needle shaft that rotates the needle along an arc is placed in the first position, slightly downwards, a direction opposite the direction of the needle sticking into the fabric, and when the needle point is leaving the fabric to be sewn, said needle shaft will be shifted to the second position, slightly downwards, a direction that is closer to the direction of the needle sticking into the fabric than the first position, so that the direction of motion of the needle point leaving fabrics is changed from that of the needle point approaching it. This method is characterized by allowing the angle of the needle the fabric to be kept small in order to completely stick the needle into a piece of thick cloth.

In other terms, the needle does not approach and penetrate the fabric in a fixed arc, since there is a separate mechanism for changing the angle of attack of the needle with each press. The needle first penetrates the fabric at a relatively shallow angle, so that the point of the needle fully penetrates the fabric. As the needle fully penetrates and leaves the fabric, the arc of travel is flattened, assuring good take-up of the fabric and smooth stitching. In effect, the scooping motion of the needle is exaggerated.

Figure 1:
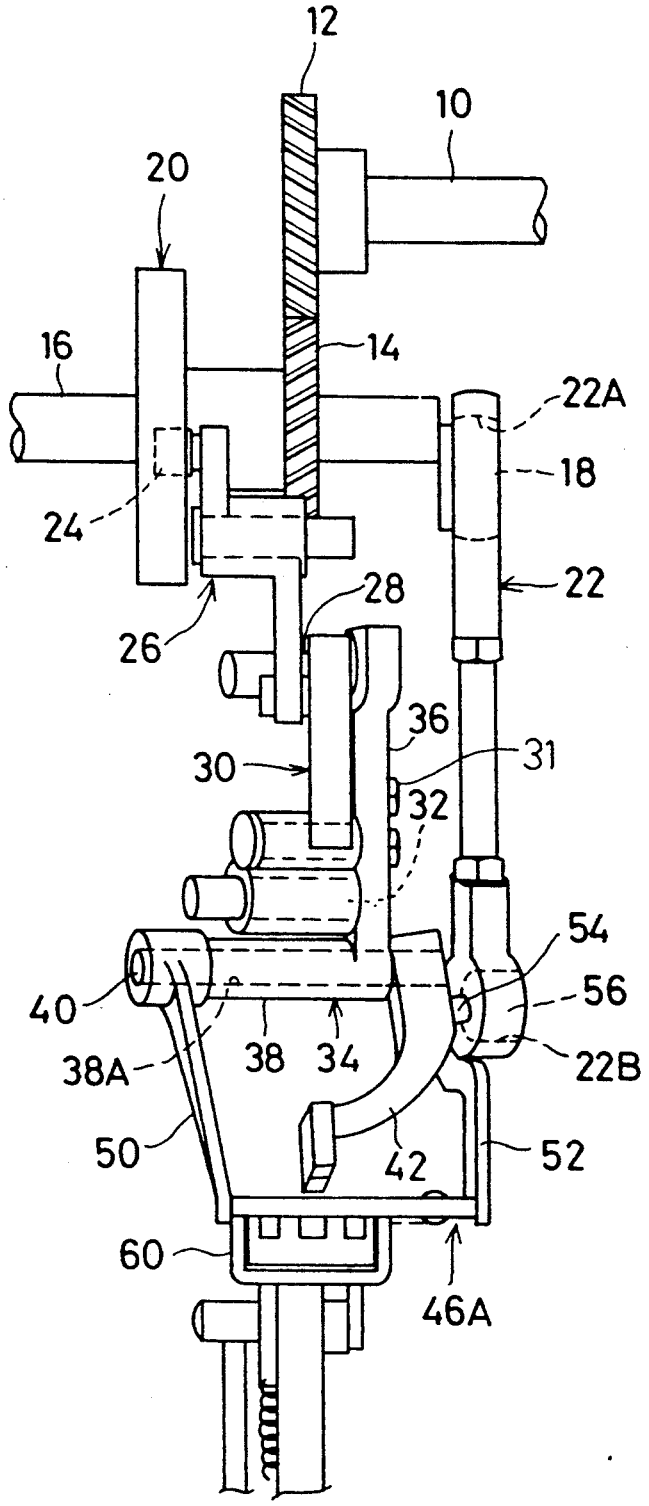
FIG. 1 is a front view of the first embodiment of the needle motion mechanism in scoop-stitch sewing machines according to the present invention.

It is noted that reference numerals 40, 44 and 44A designate a needle shaft, a needle and a needle point, respectively.

DESCRIPTION OF THE PREFERRED EMBODIMENTS

Figure 2:
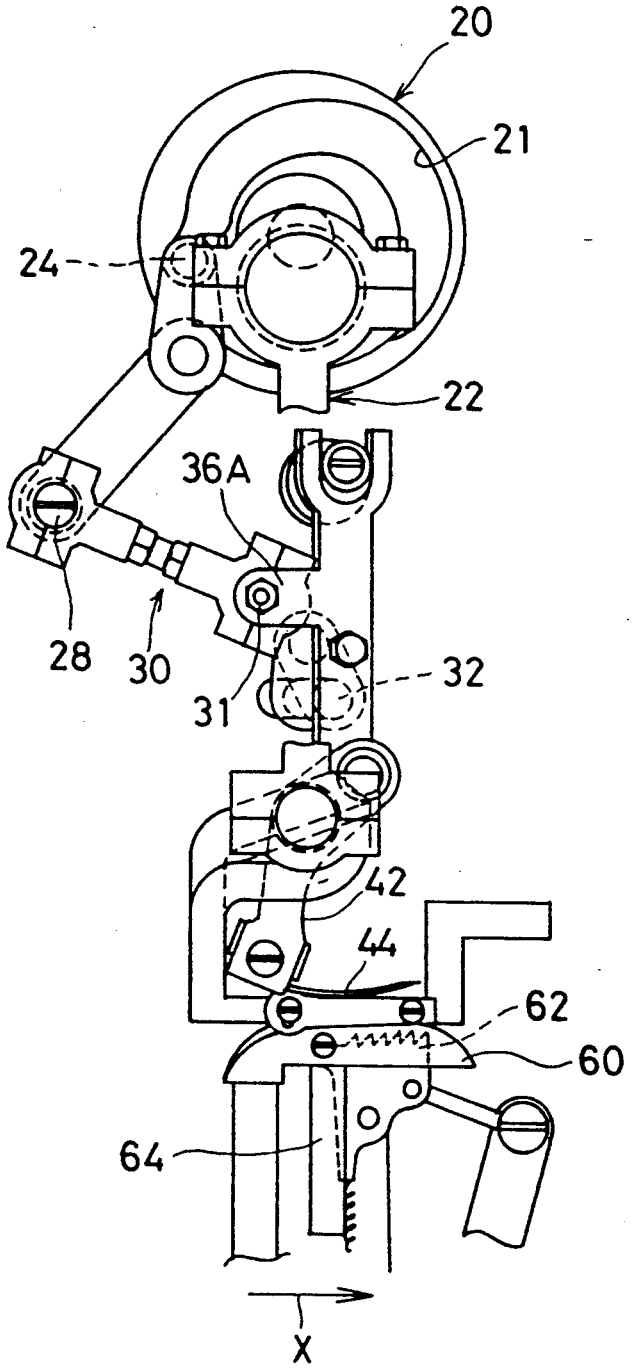
FIG. 2 is a side view of the needle motion mechanism shown in FIG. 1.
Figure 3:
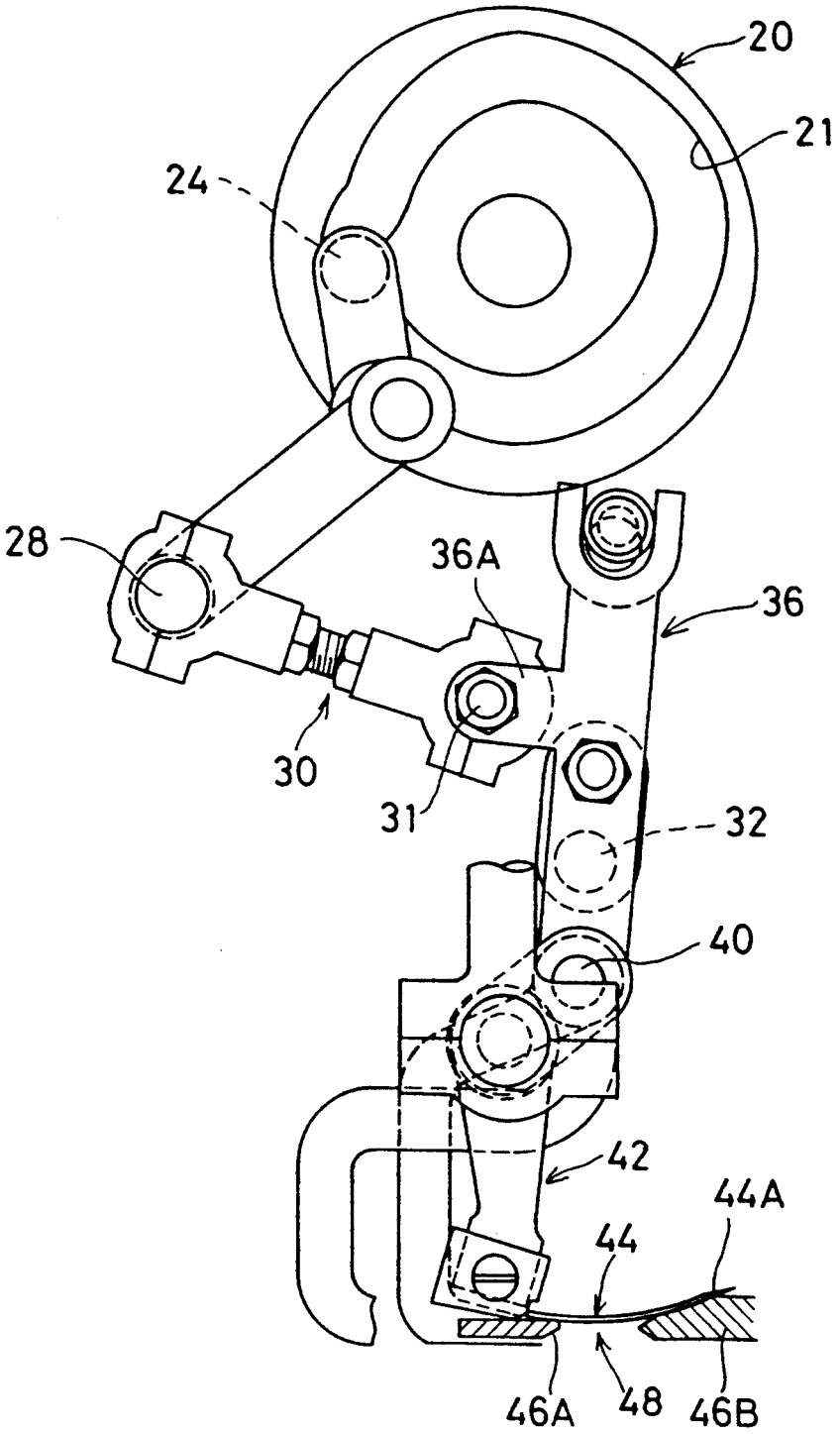
FIG. 3 is an enlarged side view of the first embodiment of the needle motion mechanism.

FIGS. 1 to 7 illustrate the first preferred embodiment of the present invention for the needle motion mechanism in scoop-stitch sewing machines. This example shows the needle motion mechanism in scoop-stitch sewing machines that has been applied to a scoop-stitch sewing machine having a needle fixed to the end of a swinging arm. As illustrated in FIG. 1, a first gear 12 is fixed to one end of a driving shaft 10 that is rotatable by suitable driving force, such as a motor. A second gear 14 is also provided in mesh with the first gear 12. To one end of a rotating shaft 16 of the second gear 14, a first link 18 is fixed, and to the middle of the shaft a revolving disc 20 also is fixed. The side face of the revolving disc 20 has a groove 21 for a cam as shown in FIGS. 2 and 3.

As illustrated in FIG. 1, the first link 18 is inserted into the hole 22A placed in the upper section of the rod 22, and thus makes it possible to provide an up-and-down motion of the rod 22.

The cam groove 21 is arranged with a revolving roller 24. A crank 26 is equipped with the roller 24. The crank 26 has a projecting member 28 which is inserted into a hole formed in the upper part of a connector 30. Another projecting member 31 also rests on the lower part of the connector 30. The projecting member 31 is inserted into a hole formed in a protruding part 36A of the arm section 36 of an L-shaped bearing 34. Into the middle of the arm section 36 is inserted a fixed shaft 32.

The bearing unit 34 has a main bearing 38 in which a hole 38A is formed. A needle shaft 40 is inserted into said hole 38A.

A reciprocating needle base or arm 42 is equipped between the above rod 22 and the main bearing 38 of the bearing unit 34. A hole is formed on the upper part of the needle base 42 and the needle shaft 40 is inserted into this hole. In addition, a curved needle 44 is fixed to the needle base 42.

As illustrated in FIG. 3, there are located a mobile needle plate 46A and a stationary needle plate 46B below the lower section of the needle 44. An opening 48 is provided between the moving needle plate 46A and the stationary needle plate 46B. As illustrated in FIG. 1, both ends of the moving needle plate 46A are supported by needle plate supporter arms 50 and 52. On the upper end of the needle plate support 50 a hole is bored into which the needle shaft 40 is inserted. Further, the upper part of the needle plate support 52 is connected with the needle base 42.

A rotating shaft 54 for the needle base is provided in the middle of the needle base 42, which can be rotated circular arc-wise around the rotating shaft 54. This rotating shaft 54 for the needle base has a projecting member 56 which is inserted into a hole 22B bored in the lower part of the rod 22 described below.

Figure 4:
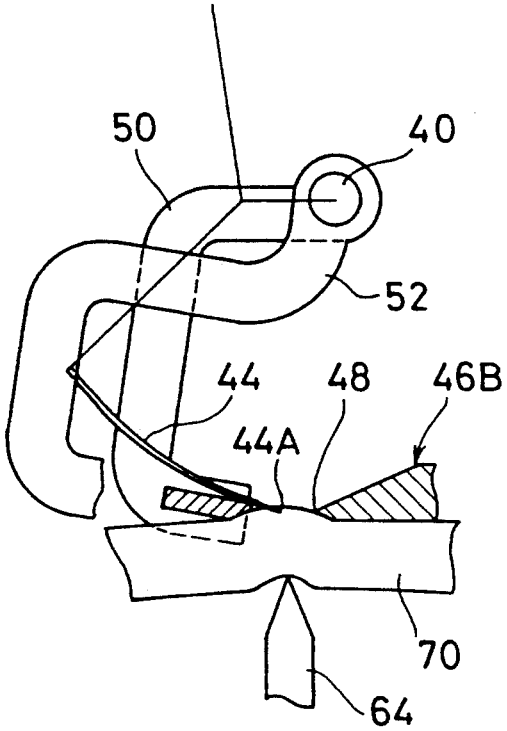
FIGS. 4, 5 and 6 are illustrations showing motion of the needle in the first embodiment.

As illustrated in FIGS. 1 and 2, a holding plate 60 is provided beneath each of the moving needle plates 46A and the stationary needle plate 46B in their equivalent position. Both a feeding teeth unit 62 and a push-up member 64 are provided beneath the holding plate 60. The feeding teeth unit 62 is used for feeding cloth 70 to a direction illustrated as an arrow X in FIG. 2, and the push-up member 64 is so designed that the cloth 70 is pushed up through the opening 48 by pushing the cloth 70 up from the underside with this device, as shown in FIG. 4.

It should be noted that other configurations including louvers in the sewing machine according to the present invention are the same as in conventional scoop-stitch sewing machines and their description is omitted herein.

Operation of the first embodiment will now be described in connection with FIGS. 1 through 7. When thick fabric 70 such as that of shoulder pads is to be sewn, the fabric 70 is first placed in the space formed between the moving needle plate 46A and the stationary needle plate 46B, and the holding plate 60. Then, the sewing machine is put into operation and the cloth 70 is fed by the feeding teeth unit 60 to a direction illustrated as a narrow X (see FIG. 2). In addition, the push-up member 64 functions to push the cloth 70 up from beneath in order to push the cloth 70 up and protrude above from the opening.

Meanwhile, the driving shaft 10 rotates the first gear 12 which in turn rotates the second gear 14, which causes the first link 18 to rotate together with the rotating disc 20. Hence the rod 22 starts a reciprocating motion with a center in its upper part.

Further, the revolving roller 24 disposed in the cam groove 21 formed in the rotating disc 20 is also rotated by action of the rotation of the rotating disc 20. Hence, the crank 26 is moved vertically. Then, the connector 30 is moved by the vertical motion of the crank 26. This time, the connector 30 is moved from back to front (from left to right).

With reference to FIGS. 4 through 7, it may be seen that the effective radius of the arc of the curved needle 44 is changed with each stroke of the needle through the fabric. In particular, the needle is caused to initially penetrate the fabric at a relatively shallow angle or small radius, and, as the needle penetrates the fabric, the arc radius is increased. In addition, the axis of the arc may be moved away from the direction of needle penetration as the needle passes through the fabric.

Figure 7:
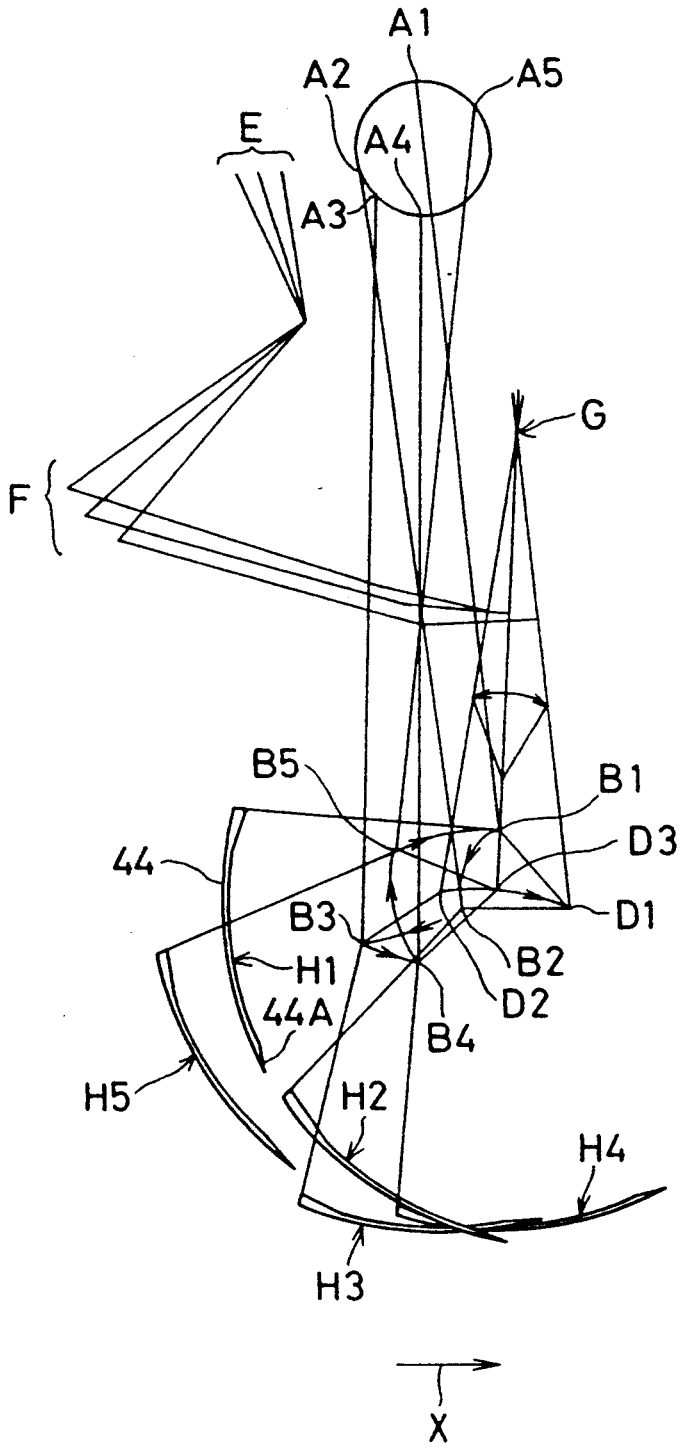
FIG. 7 is a schematic illustration showing overall motion of the needle in the first embodiment.

Referring to FIG. 7, inspection of the relationship of rod positions 22, the needle shaft 40 supported by the needle base 42 and the needle 44 reveals that, when the rod 22 is placed high in position A1, the axis of the needle shaft 40 and the needle 44 are located in position B1 and position H1, respectively. Position H1 is the highest position that the needle 44 can take. When the rod 22 is then lowered in position A2, the needle shaft 40 and the needle 44 are located in position B2 and position H2, respectively.

Figure 5:
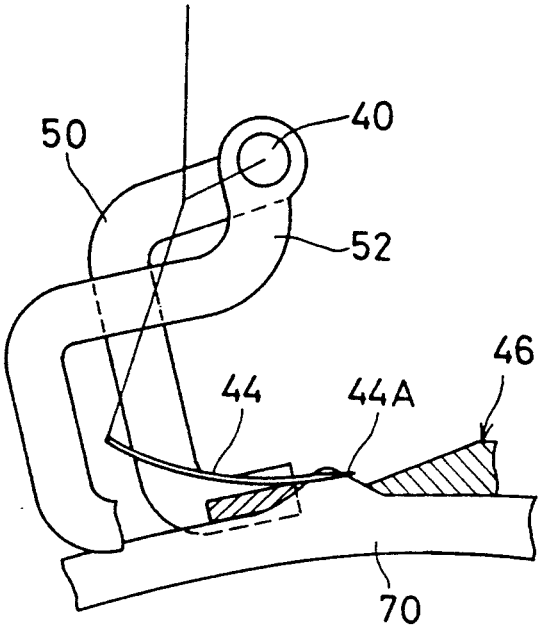
Figure 6:
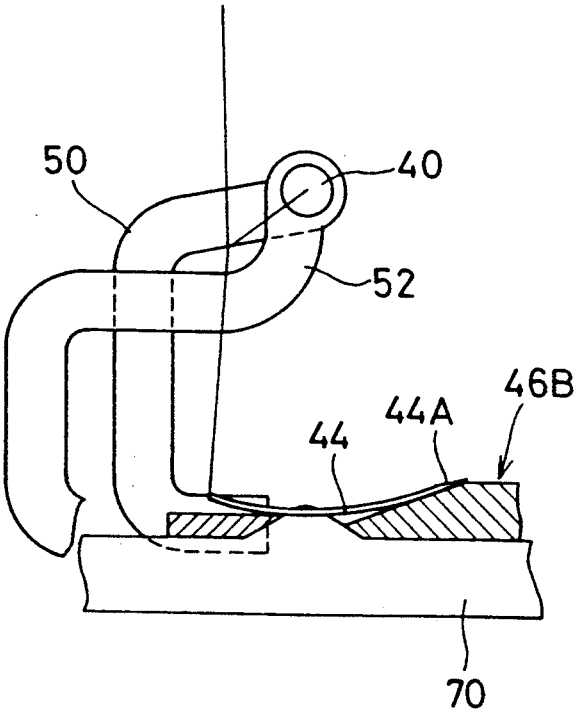

Position H2 is the position in which the point 44A of the needle 44 begins to pick the cloth 70, as also shown in FIG. 4. When the rod 22 if further lowered in position A3, the needle shaft 40 and the needle 44 are located in position B3 and position H3, respectively. Position H3 is the position in which the point 44A of the needle 44 are located in position B3 and position H3, respectively. Position H3 is the position in which the point 44A of the needle 44 is passing through the fabric, as shown in FIG. 5.

In this way, the angle of the needle to the cloth or fabric is kept shallow, such that the needle point 44A may penetrate through thick cloth 70 even if the push-up member 64 would not fully push up the cloth 70.

Note that E, F and G in FIG. 7 refer to a motion of the revolving roller 24, a motion of the projecting member 28, and a motion of the first link 18, respectively.

In summary, it will be noted the initial radius arc of the needle is at a minimum when the needle approaches the fabric at H2 and B2, and the base of the needle is lowered by increasing the radius of arc from H2 to H3. This causes an initial shallow penetration followed by a pull up on the needle point. Also, during penetration, the axis of the arc is moved away from the direction of the needle, between D1 and D2.

It should be noted that this invention is not limited to the use of a revolving disc 20 being fixed to the middle of the rotating shaft 16 of the second gear 14 and the revolving roller 24 being disposed inside the cam groove 21. For example, a cam may be equipped in the middle of the rotating shaft 16 of the second gear 14 and a revolving roller 24 may be brought in contact with the outer face of the cam.

In this example, the first link 18 is provided on the upper part of the rod 22; however, it goes without saying that a cam may be provided on the upper part of the rod 22.

In addition, although this example shows the needle shaft 40 stopping in position D3, direct shift from the position D2 to D1 may be made at a time when the rod is in position A5.

FIGS. 8 to 13 illustrate the second preferred embodiment of the present invention for the needle motion mechanism in scoop-stitch sewing machines. This example shows the needle motion mechanism that has been applied to a scoop-stitch sewing machine having a so-called mobile needle where the needle is first stuck into the cloth and then withdrawn in the opposite direction for scoop-stitch. Note that the same structure as in the first embodiment is designated by the same reference numeral without its description.

Figure 8:
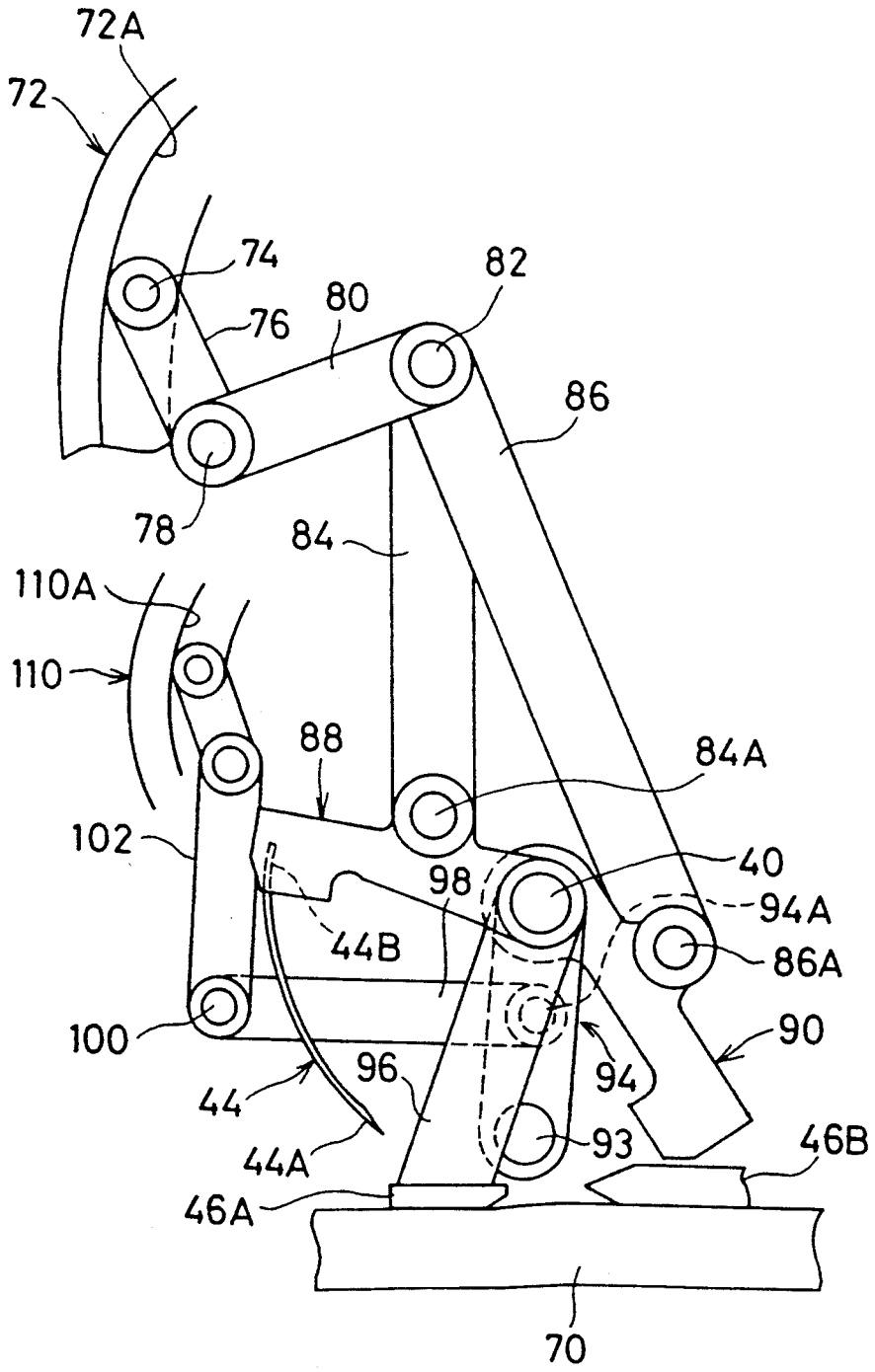
FIG. 8 is a side view of the second embodiment of the needle motion mechanism in scoop-stitch sewing machines according to the present invention.

As illustrated in FIG. 8, a first revolving disc 72 has a first groove 72A for a cam, and a first revolving roller 74 is disposed on the first cam groove 72A. A first arm 76 connected with this first revolving roller 74 is in turn connected with a second arm 80 via a pin 78. In the other end of this second arm 80 is inserted a supporting pin 82. A first supporting rod 84 and a second supporting rod 86 are supported by the supporting pin 82.

A first needle base 88 is rotatably provided on the tip of the first supporting rod 84 by means of a pin 84A. Furthermore, a second needle base 90 is rotatably provided on the tip of the second supporting rod 86 by means of a pin 86A. A first needle base 88 is so formed that it can receive and hold the base 44 of a needle 44 while the second needle base 90 is so formed that it can receive and hold the tip 44A of the needle 44.

There are provided a rod 94 and a needle plate supporter 96 of a mobile needle plate 46A on the needle shaft 40. Into the one end of the rod 94 is inserted a stationary shaft 93, and the rod 94 can be rotatable around the stationary shaft 93.

A pin 94A is provided in the middle of the rod 94, and supports a third arm 98, which in turn is connected with a fourth arm 102 by means of a pin 100. The fourth arm 102 is connected with a fifth arm 106 by means of a pin 104. A second revolving roller 108 is provided on the fifth arm 106. A second cam groove 110A formed on a second revolving disc 110 receives the second revolving roller 108 for reciprocating motion.

Figure 9:
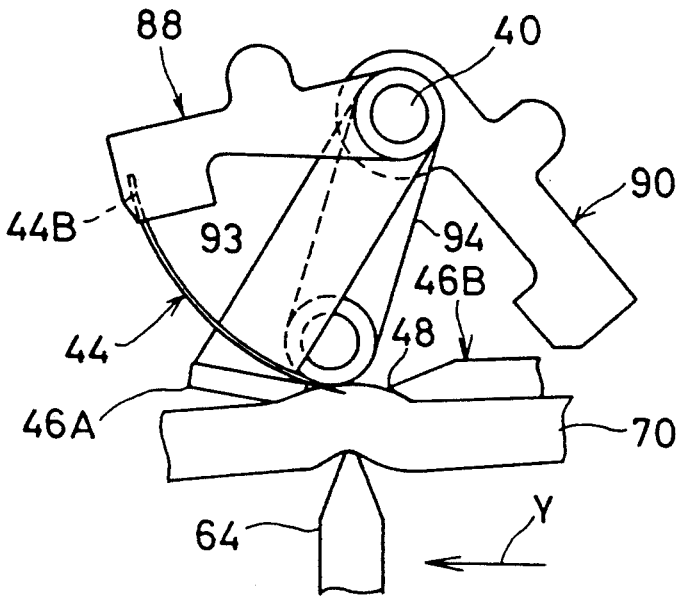
FIGS. 9 through 13 are illustrations showing motion of the needle in the second embodiment.

Operation of the second embodiment is described hereinafter. When thick fabric 70 such as that of shoulder pads is sewn, said cloth 70 is first placed in the space formed between the mobile needle plate 46A and the stationary needle plate 46B, and the holding plate 60. Then, the sewing machine is put into operation and the cloth 70 is fed to a direction opposite the direction of an approaching needle to a direction indicated as an arrow Y in FIG. 9. In addition, the push-up member 64 functions to push the cloth 70 up from beneath in order to push the cloth 70 up into the opening 48. In this case, the first needle base 88 retains the base 44B of the needle 44. Then, the first needle base 88 rotates counter-clockwise to cause the point 44A of the needle 44 to approach the cloth 70 for penetrating as shown in FIG. 9.

Figure 10:
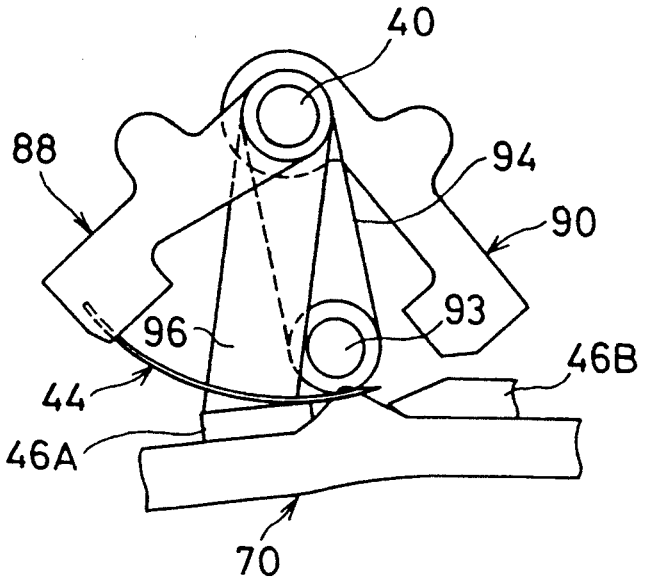

Then, the rod 94 rotates counter-clockwise with the fixed shaft 93 as its center. As the first needle base 88 approaches the cloth 70, the angle of the first needle base 88 to the cloth become smaller, allowing the machine to fully penetrate the needle 44 into the cloth 70. In this case, the first needle base 88 and the second needle base 90 approach each other, and the mobile needle plate 46A also approaches the fixed needle plate as shown in FIG. 10.

Figure 11:
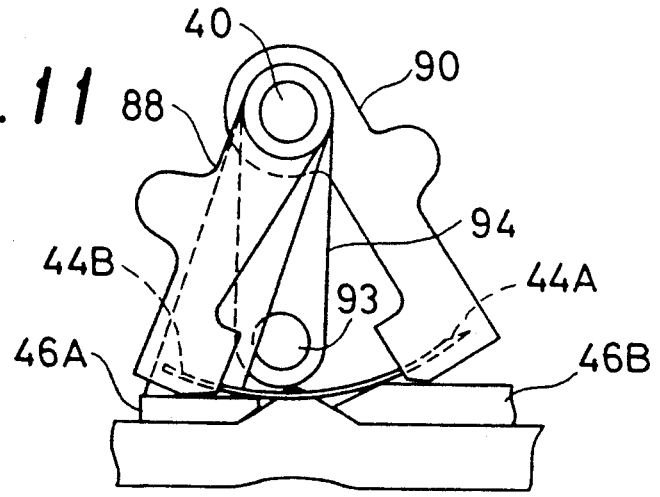

Then, the point 44A of the needle 44 is inserted into the second needle base 90 which then retains the needle point 44 securely as shown in FIG. 11. At the same time, the push-up member 64 shifts back downwards to release its push-up action.

Figure 12:
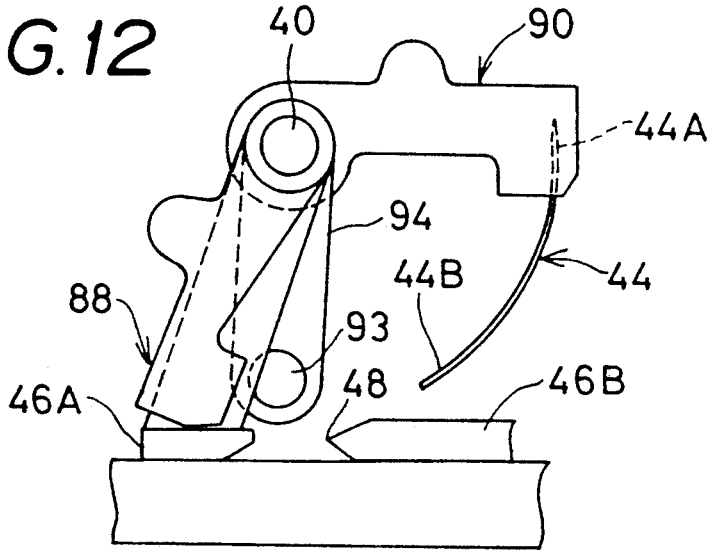

Next, the first needle base 88 releases its retaining of the base 44B of the needle 44, and the second needle base 90 rotates counter-clockwise to allow the needle to be withdrawn from the cloth 70 as shown in FIG. 12.

Figure 13:
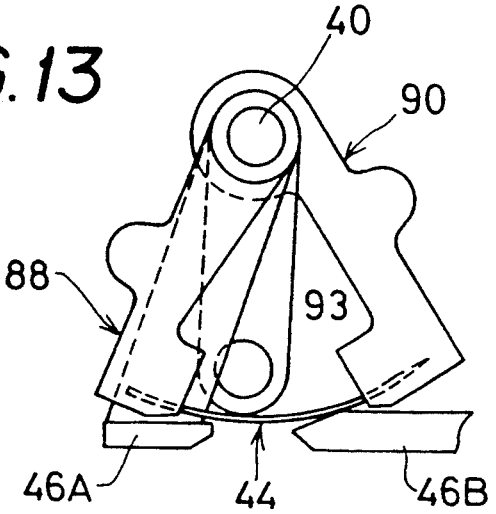

Then, the second needle base 90 rotates clockwise to cause the needle that has been retained inside the base to be inserted again into the first needle base 88, and the base 44B of the needle 44 is then securely retained in the first needle base 88 as shown in FIG. 13. Repeating this action cycle-wise permits a reliable seam on the cloth 70.

As set forth hereinabove, the present invention provides an improved of needle motion mechanism in scoop-stitch sewing machines which permits full penetration of a needle even in thick cloth swiftly and simply. In addition, other excellent effects such as beautiful seams can be obtained using this invention.

I claim:

1. A method for performing scoop-stitching wherein a curved needle is repeatedly moved along an arc of travel around a normally fixed radius into and out of penetrating engagement with fabric to be sewn, said method comprising the steps of changing the arc of travel of the needle before penetration of the fabric such that the needle first penetrates the fabric along an arc having a radius less than said fixed radius, and after the needle has penetrated the fabric, changing the arc of travel to an increased radius.

2. The method of claim 1 wherein the arc of said needle has a variable radius which is progressively increased after penetration of the needle with the fabric.

3. The method of claim 2 wherein said arc is defined by an axis of rotation, and said axis is moved toward said fabric after needle penetration.

4. The method of claim 3 wherein said axis is additionally moved in a direction opposition to movement of the needle.

* * * * *